US006505443B1

(12) United States Patent
Budescu

(10) Patent No.: US 6,505,443 B1
(45) Date of Patent: Jan. 14, 2003

(54) COLLAPSIBLE STRUCTURAL ELEMENT

(75) Inventor: Dan Budescu, Haifa (IL)

(73) Assignee: A.P.S. Advanced Pneumatic Structures Ltd., Nesher (IL)

( * ) Notice: Subject to any disclaimer, the term of this patent is extended or adjusted under 35 U.S.C. 154(b) by 0 days.

(21) Appl. No.: 09/830,885

(22) PCT Filed: Nov. 3, 1999

(86) PCT No.: PCT/IL99/00586

§ 371 (c)(1),
(2), (4) Date: May 2, 2001

(87) PCT Pub. No.: WO00/26482

PCT Pub. Date: May 11, 2000

(51) Int. Cl.[7] ..... E04H 12/18
(52) U.S. Cl. ..... 52/108; 52/108; 52/648.1
(58) Field of Search ..... 52/108, 648.1

(56) References Cited

U.S. PATENT DOCUMENTS

| | | | |
|---|---|---|---|
| 395,086 | A | 12/1888 | Spriggs |
| 979,408 | A | 12/1910 | Baird |
| 1,053,933 | A | 2/1913 | Stowe |
| 1,100,829 | A | 6/1914 | Joseph |
| 3,300,910 | A | 1/1967 | Isaac |
| 3,674,110 | A | 7/1972 | Cooke |
| 4,550,541 | A | 11/1985 | Whitlam et al. |
| 4,986,535 | A | 1/1991 | Hull et al. |
| 5,718,952 | A | 2/1998 | Zimmermann et al. |
| 5,752,459 | A | 5/1998 | Rexroad |

*Primary Examiner*—Carl D. Friedman
*Assistant Examiner*—Nahid Amiri
(74) *Attorney, Agent, or Firm*—Mark M. Friedman

(57) ABSTRACT

A collapsible beam element is provided, including: (a) an elongated flexible structural member having a predetermined cross section; and (b) a hollow defined by the cross section of the flexible structural member, wherein the flexible structural member is collapsible so as to enable folding of the beam element from an open configuration into a packed configuration, and wherein the flexible structural member readopts the predetermined cross section when unfolding the beam element from a packed configuration into an open configuration. The beam element is preferably made of material having predetermined shape. The beam element may be used so as to construct any collapsible three dimensional construction. Amongst other possibilities, the beam element may be used as a stretcher beam or a ladder or bridge beam.

10 Claims, 3 Drawing Sheets

COLLAPSIBLE STRUCTURAL ELEMENT

FIELD AND BACKGROUND OF THE INVENTION

The present invention relates to a collapsible structural element and, more particularly to a collapsible beam which can be folded into a compact form.

Collapsible structural elements are well known in the art. Examples of such collapsible structural elements are disclosed in U.S. Pat. Nos. 395,086; 979,408; 1,053,933 and 1,100,829.

However, none of the inventions described in the above patents disclose a collapsible structural element such as a beam made of a material having a self memory which enables expansion of the structural element so as to adopt to a desired three dimensional conformation upon unfolding of the structural element from a packed configuration into an open configuration.

There is thus a widely recognized need for, and it would be highly advantageous to have, a collapsible structural element such as a beam which can be expanded so as to adopt to a desired three dimensional conformation upon unfolding of the beam from a packed configuration into an open configuration.

It would be further advantageous to have such a collapsible beam element which can be used to support a larger structural element such as, e.g., a stretcher, bridge or a ladder and which further enables compact packing of such larger structural element.

It would be further advantageous to have such a collapsible beam which is made of a material having a predefined shape thereby enabling expansion of the collapsible beam so as to feature any desired three dimensional conformation.

Another prior art device that attempts to remedy the deficiencies of the above patents is Isaac, U.S. Pat. No. 3,300,910. Isaac teaches a reelable member having inflation means that allows the member to expand after been unreeled. Inflatable elements located within its hollow interior permit the member to retain its shape while unreeled. When reeled-in, the member is collapsible into a compact form.

SUMMARY OF THE INVENTION

According to the present invention there is provided a collapsible structural element, including: (a) a flexible structural member having a predetermined three dimensional conformation; and (b) a hollow defined by the three dimensional configuration of the flexible structural member, wherein the flexible structural member may be collapsed so as to substantially eliminate the hollow, thereby enabling folding of the collapsible structural element from an open configuration into a packed configuration. The flexible structural member readopts the predetermined three dimensional conformation when unfolding the collapsible structural element from a packed configuration into an open configuration.

Specifically, according to the present invention there is provided a collapsible beam element, including: (a) an elongated flexible structural member having a predetermined cross section; and (b) a hollow defined by the cross section of the flexible structural member, wherein the flexible structural member may be collapsed so as to substantially eliminate the hollow, thereby enabling folding of the beam element from an open configuration into a packed configuration, and wherein the flexible structural member readopts the predetermined cross section when unfolding the beam element from a packed configuration into an open configuration.

According to further features in preferred embodiments of the invention described below, the flexible structural member may include a first and second members, the first and second members being interconnected so as to define the hollow.

According to still further features in preferred embodiments of the invention described below, the beam element is used as a stretcher beam. Alternatively, the beam element may be used as a ladder beam or bridge beam, amongst many other possible usages.

The present invention successfully addresses the shortcomings of the presently known configurations by providing a collapsible structural element such as a beam made of a material having a predetermined shape, or forced to a predetermined shape, which enables expansion of the structural element so as to adopt a desired three dimensional conformation upon unfolding of the structural element from a packed configuration into an open configuration.

When using a device according to the present invention, the collapsible beam element is collapsed and rolled so as to adopt a compact packed configuration. The beam element is then unfolded so as to readily adopt a predetermined three dimensional conformation,

BRIEF DESCRIPTION OF THE DRAWINGS

The invention is herein described, by way of example only, with reference to the accompanying drawings, wherein.

DESCRIPTION OF THE PREFERRED EMBODIMENTS

The present invention is of a collapsible structural element such a as a beam which can be folded into a compact form.

The principles and operation of apparatus and method according to the present invention may be better understood with reference to the drawings and the accompanying description.

Figure 1:
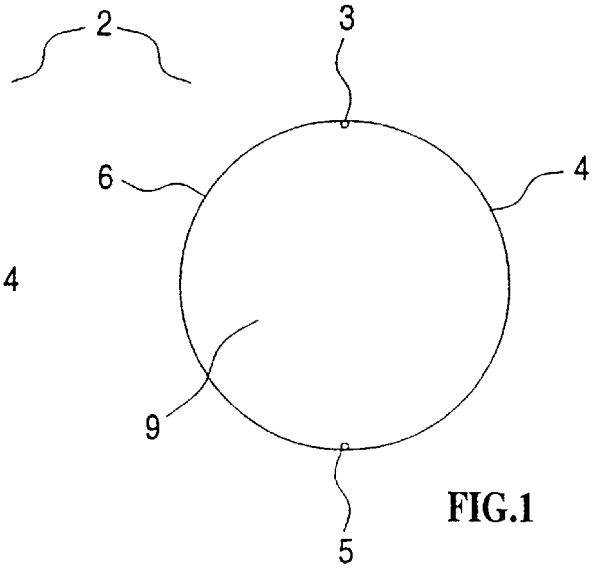
FIG. 1 is a cross sectional view of an embodiment of a collapsible beam element according to the present invention in an expanded configuration.

Referring now to the drawings, FIG. 1 is a cross sectional view of a beam element according to the present invention in its expanded form. As shown in the figure, a beam element 2 according to the present invention preferably includes first and second elongated flexible structural members, 4 and 6, the flexible structural members being interconnected at hinges 3 and 5 so as to form a hollow 9 therebetween. Preferably, each of flexible structural members 4 and 6 features a shape such that beam 2 is substantially cylindrical in cross section.

Flexible structural members 4 and 6 are preferably made of any material having a predetermined shape. For example, flexible structural members 4 and 6 may be made of metal, or a metal core coated with elastomeric material. Flexible structural members 4 and 6 may feature a specific elasticity in one direction and a specific rigidity in another direction. Further, flexible structural members 4 and 6 may be made of composite materials or any other suitable material.

Flexible structural members 4 and 6 may be enclosed by an enclosing layer 8 preferably made of a soft material such as canvas or any elastomeric material.

Figure 2:
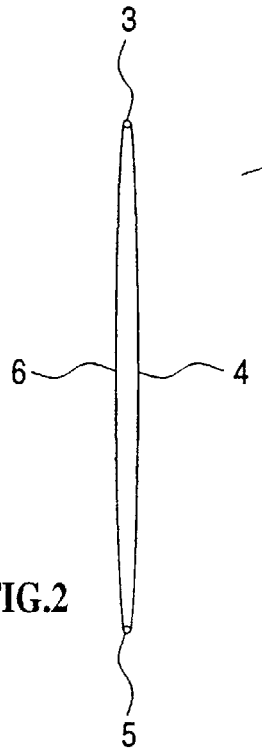
FIG. 2 is a cross sectional view of the collapsible beam element shown in FIG. 1 in a collapsed configuration.

As shown in FIG. 2, when collapsing beam element 2 by pressing flexible structural member 4 against flexible structural member 6, beam element 2 adopts a substantially flattened cross section thereby enabling rolling of beam element 2 along its length into a compact packed configuration.

Flexible structural members 4 and 6 may adopt any predetermined cross sectional configuration in their expanded form, thereby conferring any predetermined cross sectional configuration to beam element 2.

Figure 3:
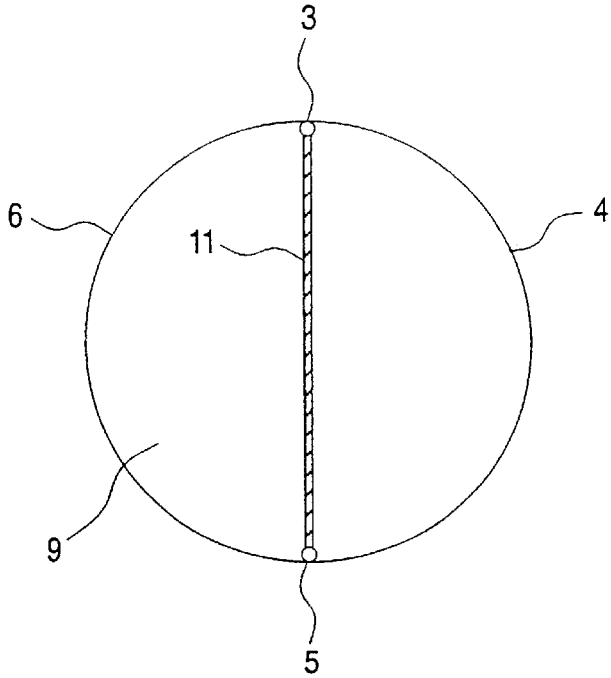
FIG. 3 is a cross sectional view of a preferred embodiment of the collapsible beam member according to the present invention in an expanded configuration.
Figure 4:
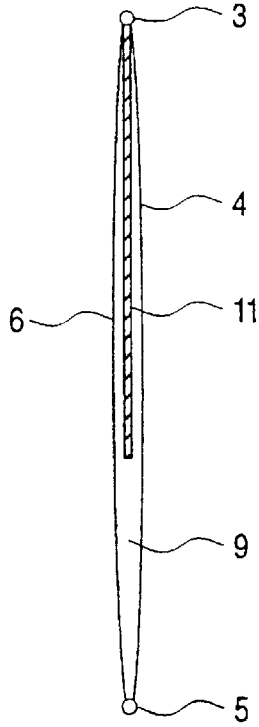
FIG. 4 is a cross sectional view of the collapsible beam element shown in FIG. 3 in a collapsed configuration.

Referring now to FIGS. 3 and 4, there is illustrated a preferred mode of the collapsible beam element according to the present invention. A main load-carrying element 11 is provided along the length of members 4 and 6 and is connected thereto at hinge 3 and 5. The length of element 11 is such that when beam element 2 is unfolded from a packed configuration, shown in FIG. 4, to adopt to its predetermined three dimensional configuration shown in FIG. 3, element 11 extends to hinge 5 connecting members 4 and 6. In this configuration, element 11 provides most of the support for any load placed along the beam length when it is in its unfolded state, whereby members 4 and 6 avoids the collapse of the element 11.

Figure 5:
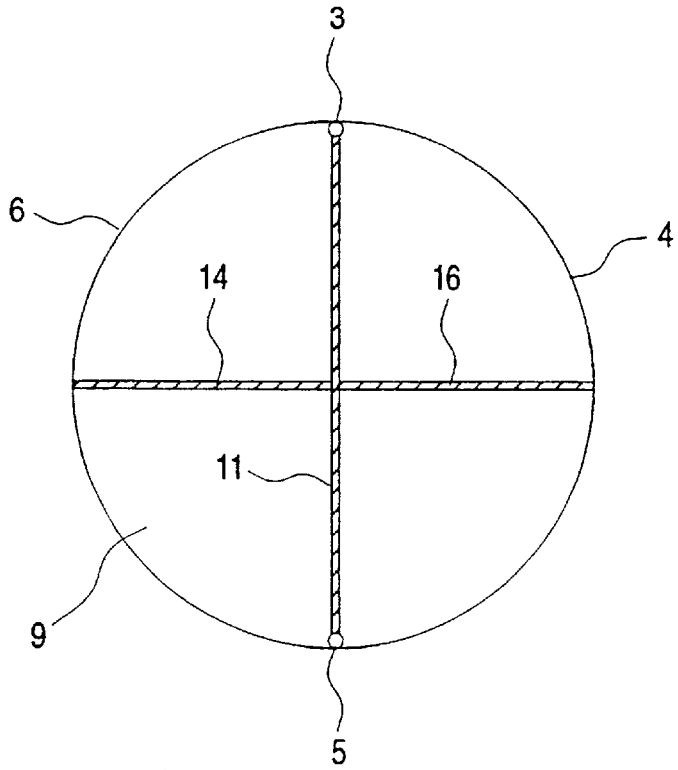
FIG. 5 is a cross sectional view of a second preferred embodiment of the collapsible beam member according to the present invention in an expanded configuration.

In FIG. 5, there is illustrated a further preferred embodiment of the invention wherein further strength is provided for the three dimensional configuration along the transverse length of the beam 2. Element 11 is provided with wing extensions 14 and 16 located midway along its length, the extensions are forced to expand in a direction transverse to element 11 when beam 2 is unfolded. As shown in FIG. 5, when opened, extensions 14 and 16 reach members 4 and 6, respectively. Thus, support for beam 11 is provided by both element 11 and members 14 and 16 along the beam.

In this example, the structural members 4 and 6 do not have a predetermined shape. They are froced into their cross sectional shape by extensions 14 and 16.

Figure 6:
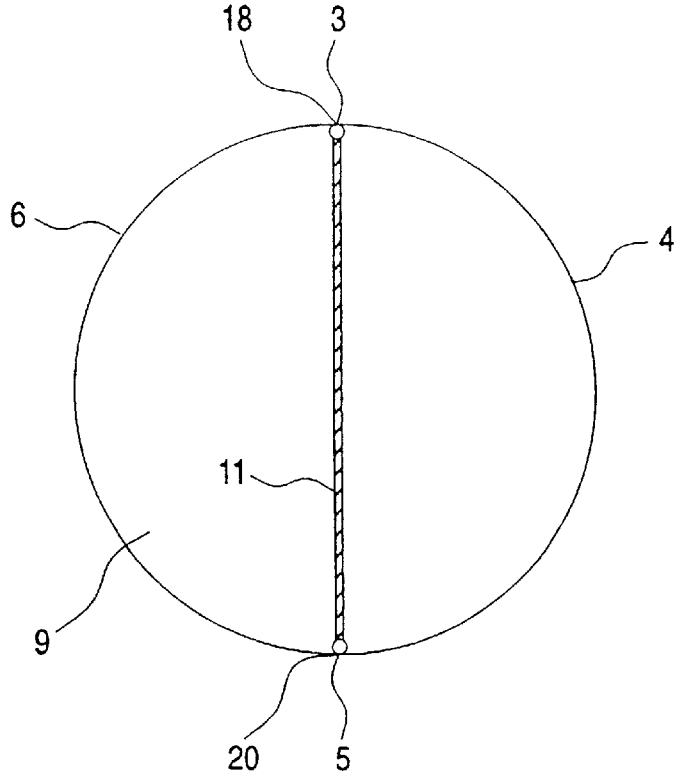
FIG. 6 is a cross sectional view of a further preferred embodiment of the collapsible beam member according to the present invention in an expanded configuration.

In FIG. 6, there is illustrated a further preferred embodiment of the invention wherein further strength is provided for the three dimensional configuration along the transverse length of the beam 2. In this embodiment, member 4 is not identical to member 6 and is provided with extensions 18 and 20. As shown in FIG. 6, when unfolded, extensions 18 and 20 overlap interconnection hinges 3 and 5, respectively, thereby providing additional strength for the beam 2.

According to another configuration (not shown), beam element 2 includes a chamber filled with a gel, which gel being rigidified upon heating and liquified upon cooling. Further, beam element 2 is preferably connectable to a cooling source for liquefying the gel and to a heating source for rigidifying the gel. Alternatively, the cooling source and the heating source may be accommodated within beam element 2. The cooling source may be a source of liquid nitrogen. The heating source may include a current source connected to a resistor received within the gel.

According to another embodiment (not shown), beam element 2 may include apertures extending along its length for insertion of a thread therethrough. For example, beam 2 may include at least two lines of apertures interconnected by a single thread such that beam 2 adopts a predetermined cross sectional configuration by fastening the thread. The thread may be made of a material which is contractible upon heating and extendable upon cooling.

According to another configuration (not shown), flexible structural members 4 and 6 may feature substantially a flat shape and may adopt a hemicylindrical or any other shape upon fastening of the thread.

A collapsible beam element according to the present invention may be used, for example, as a stretcher beam or a ladder beam. Further, such collapsible beam element may be used for constructing a bridge. Further, such an expandable beam element may be used as a part of mechanical apparatus. Specific example may be a robot arm.

Figure 7:
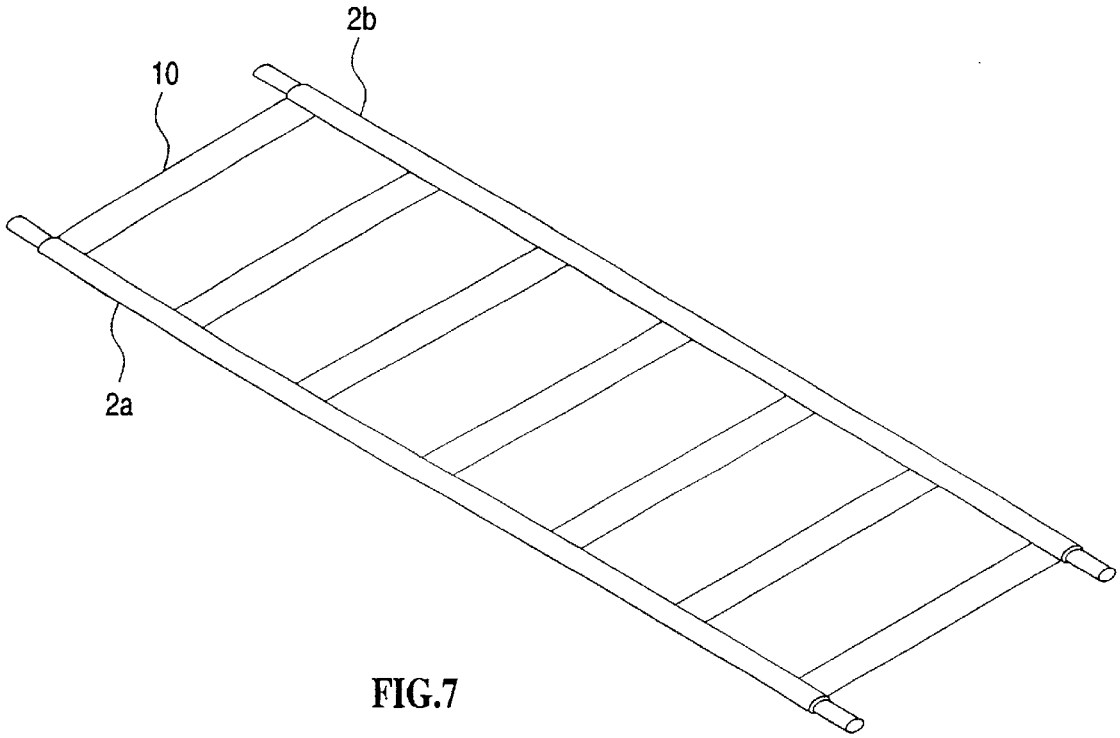
FIG. 7 is a schematic illustration of a stretcher element including collapsible beams according to the present invention in an open configuration.

As shown in FIG. 7, two collapsible beam elements 2*a* and 2*b* may be used as stretcher beams. Collapsible beam elements 2*a* and 2*b* may be interconnected by means of connecting elements 10, the connecting elements preferably for carrying a patient and for transferring the load from the patient to beam elements 2*a* and 2*b*.

Figure 8:
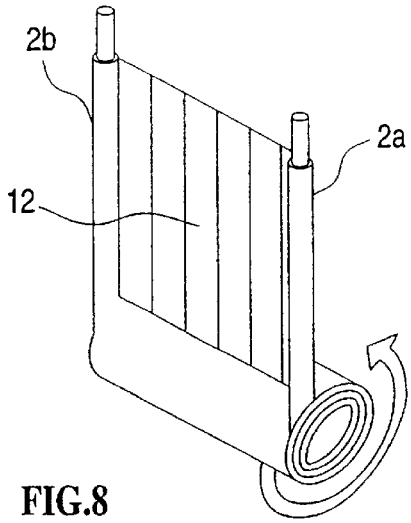
FIG. 8 is a schematic illustration of another embodiment of a stretcher element according to the present invention in a partially folded configuration.

As shown in FIG. 8, connecting elements 10 may be covered by a canvas sheet 12 or any other flexible material.

Further as shown in FIG. 8, beam elements 2*a* and 2*b* may be collapsed and rolled along their length so as to fold the stretcher into a compact packed configuration. When unfolding the stretcher from a packed configuration (FIG. 8) into an open configuration (FIG. 7), beam elements 2*a* and 2*b* readopt their predetermined cross sectional conformation.

When using beam elements 2*a* and 2*b* as ladder beams, connecting elements 10 (FIG. 7) are used as ladder levels.

Collapsible beam elements according to the present invention may be used for constructing any three dimensional construction, such as a tent. Further, although the invention has been herein described with reference to a collapsible beam element, its principles of operation may be used so as to provide any two dimensional or three dimensional collapsible structural elements.

While the invention has been described with respect to a limited number of embodiments, it will be appreciated that many variations, modifications and other applications of the invention may be made.

What is claimed is:

1. An elongated flexible structural member including first and second members interconnected at first and second interconnection points to define a hollow having a predetermined cross section;

wherein said flexible structural member is collapsible so as to substantially eliminate said hollow thereby enabling folding of said beam element from an open configuration into a packed configuration;

wherein said flexible structural member readopts to said predetermined cross section when unfolding said beam element from a packed configuration into an open configuration;

further including an element coupled to one of said interconnection points extending along the length of said members, said element having a length sufficient to reach the other interconnection point of said members when said beam element is unfolded into an open configuration, said element providing support for loads placed upon said beam in its unfolded state.

2. The beam element of claim 1, herein said flexible structural member is made of metal.

3. The beam element of claim 1, further including extension members located midway along said element, said extension members expanding in directions transverse to said element when said beam is unfolded to reach opposite sides of said members, thereby providing support in a direction transverse to said beam.

4. The beam element of claim 1, further including an extensions located at both ends of one of said members so that said extensions overlap said first and second interconnection points to provide additional support for said beam when unfolded into an open configuration.

5. A collapsible beam element comprising:

(a) a first elongated flexible structural member;

(b) a second elongated flexible structural member interconnected with said first member along a length of the collapsible beam element by a first interconnection line and by a second interconnection line to define a hollow having a predetermined cross section, wherein said flexible structural members are collapsible to form a folded configuration, such that said hollow is substantially eliminated when said flexible structural members are collapsed in said folded configuration, and wherein said flexible structural members reversibly readopt said predetermined cross section when said flexible structural members are disposed in an open configuration, and wherein said first elongated flexible structural member and said second elongated flexible structural member form a single wall bounding said hollow.

6. The collapsible beam element of claim 1, wherein said beam element is a structural beam of a stretcher.

7. The collapsible beam element of claim 1, wherein said beam element is a structural beam of a ladder.

8. The collapsible beam element of claim 1, wherein said beam element is a structural beam of a three dimensional construction.

9. The collapsible beam element of claim 5, wherein said flexible structural member is made of metal.

10. The collapsible beam element of claim 5, further including extension members located midway along said element, said extension members expanding in directions transverse to said element when said beam is unfolded to reach opposite sides of said members, thereby providing support in a direction transverse to said beam.

* * * * *

UNITED STATES PATENT AND TRADEMARK OFFICE

CERTIFICATE OF CORRECTION

PATENT NO. : 6,505,443 B1
DATED : January 14, 2003
INVENTOR(S) : Budescu

It is certified that error appears in the above-identified patent and that said Letters Patent is hereby corrected as shown below:

Column 4,
Line 55, on the first line of claim 1:, insert the following words before "an":
-- A collapsible beam element, comprising: --

Signed and Sealed this

Eighth Day of July, 2003

JAMES E. ROGAN
*Director of the United States Patent and Trademark Office*